US009039005B2

(12) United States Patent
Minoshima et al.

(10) Patent No.: US 9,039,005 B2
(45) Date of Patent: May 26, 2015

(54) IMAGE FORMING APPARATUS

(71) Applicants: Saya Minoshima, Gifu (JP); Junki Ueyama, Nagoya (JP)

(72) Inventors: Saya Minoshima, Gifu (JP); Junki Ueyama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/200,041

(22) Filed: Mar. 7, 2014

(65) Prior Publication Data

US 2014/0252715 A1 Sep. 11, 2014

(30) Foreign Application Priority Data

Mar. 7, 2013 (JP) ..... 2013-045177
Mar. 7, 2013 (JP) ..... 2013-045180
Mar. 7, 2013 (JP) ..... 2013-045185

(51) Int. Cl.

*B65H 3/44* (2006.01)
*B65H 1/04* (2006.01)
*B65H 3/06* (2006.01)
*B65H 9/00* (2006.01)

(52) U.S. Cl.

CPC ..... *B65H 1/04* (2013.01); *B65H 2405/11162* (2013.01); *B65H 2402/442* (2013.01); *B65H 2402/412* (2013.01); *B65H 2402/441* (2013.01); *B65H 2405/332* (2013.01); *B65H 3/0615* (2013.01); *B65H 3/0684* (2013.01); *B65H 9/00* (2013.01)

(58) Field of Classification Search

CPC ..... B65H 1/00; B65H 2402/412; B65H 2402/441; B65H 2402/442; B65H 2405/11162; B65H 2405/332
USPC ..... 271/9.07, 9.08, 171
See application file for complete search history.

(56) References Cited

U.S. PATENT DOCUMENTS 5,269,508 A * 12/1993 Hattori ..... 271/171
2009/0194931 A1* 8/2009 Shiohara et al. ..... 271/8.1
2010/0172678 A1* 7/2010 Kim ..... 399/393
2012/0070185 A1 3/2012 Yokota
2013/0177783 A1 7/2013 Marutani et al.
2013/0249161 A1* 9/2013 Uchino ..... 271/9.01

FOREIGN PATENT DOCUMENTS

JP 2012-068371 A 4/2012
JP 2012-069371 A 4/2012

* cited by examiner

*Primary Examiner* — Michael McCullough
*Assistant Examiner* — Howard Sanders
(74) *Attorney, Agent, or Firm* — Banner & Witcoff, Ltd.

(57) ABSTRACT

An image forming apparatus, including a chassis with an opening formed on one side thereof; a first placement section, on which a sheet inserted through the opening is placeable; a cover configured to be openable to expose and closable to cover the opening and configured to form, when in a position to expose the opening, an outer part of the first placement section outside the chassis; and a second placement section arranged in an upper position with respect to the first placement section, and on which a sheet inserted through the opening is placeable, is provided. The second placement section is detachably attached to the chassis through the opening.

21 Claims, 11 Drawing Sheets

IMAGE FORMING APPARATUS

CROSS REFERENCE TO RELATED APPLICATION

This application claims priority from Japanese Patent Application Nos. 2013-045177, 2013-045180, and 2013-045185, filed on Mar. 7, 2013, the entire subject matters of which are incorporated herein by reference.

BACKGROUND

1. Technical Field

An aspect of the present invention relates to an image forming apparatus having a manual sheet feeder tray.

2. Related Art

Conventionally, an image forming apparatus with a chassis, in which a recording sheet to be fed to an image forming unit can be inserted through an opening formed on one side (e.g., a front side) of the chassis, is known. The image forming apparatus may have a feeder tray, on which the recording sheets inserted through the opening are placed, and a manual-feeder tray, on which the recording sheets manually inserted through the opening are placed. The recording sheets to be placed on the feeder tray may be inserted through a lower part of the opening, and the recording sheets to be placed on the manual-feeder tray may be inserted through an upper part of the opening. The image forming apparatus may further include a pickup roller disposed on another side (e.g., a rear side) of the image forming apparatus in an upper position with respect to the feeder tray. In this regard, the manual-feeder tray may be disposed to range from the opening toward the pickup roller in a linearly inclined posture to be closer to a sheet placement surface of the feeder tray.

SUMMARY

With the manual-feeder tray occupying in the upper range with respect to the feeder tray, a volume of a space inside the chassis, which may be accessed by a user through the opening, may be reduced. Therefore, it may be difficult for the user to insert his/her hand through the opening toward the rear side when, for example, a jammed recording sheet needs to be removed, or other maintenance works are required.

Further, with the manual-feeder tray in the inclined posture, a gap between the manual-feeder tray and the feeder tray may be narrowed to be even smaller toward the rear side of the chassis. Thus, the deeper space inside the chassis with respect to the opening may even be narrowed, and it may be even more difficult for the user to insert his/her hand through the opening deeper toward the rear side.

The present invention is advantageous in that an image forming apparatus, to which the user can provide maintenance works easily, is provided.

According to an aspect of the present invention, an image forming apparatus is provided. The image forming apparatus includes a chassis with an opening formed on one side thereof; a first placement section, on which a sheet inserted through the opening is placeable; a cover configured to be openable to expose and closable to cover the opening and configured to form, when in a position to expose the opening, an outer part of the first placement section outside the chassis; and a second placement section arranged in an upper position with respect to the first placement section, and on which a sheet inserted through the opening is placeable. The second placement section is detachably attached to the chassis through the opening.

BRIEF DESCRIPTION OF THE ACCOMPANYING DRAWINGS

DETAILED DESCRIPTION

Hereinafter, an embodiment according to an aspect of the present invention will be described with reference to the accompanying drawings. In the following description, first, an overall configuration of a laser printer 1 being an image forming apparatus will be described, and second, detailed configuration of specific parts in the laser printer 1 will be described.

Figure 1:
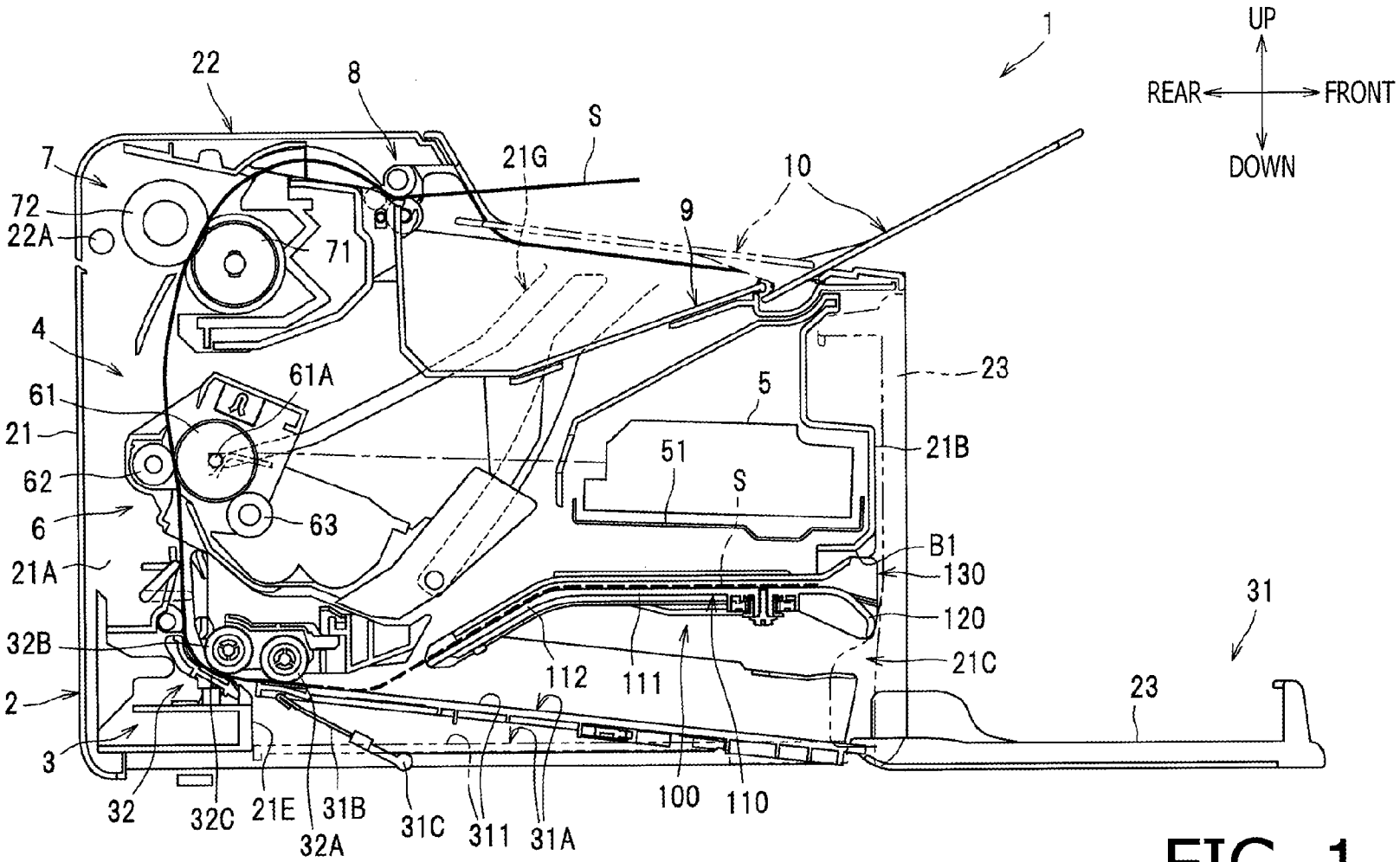
FIG. 1 is a cross-sectional side view of a laser printer with a manual-feeder tray according to an embodiment of the present invention.

In the present embodiment, directions concerning the laser printer 1 will be referred to in accordance with orientation indicated by arrows in each drawing. Therefore, for example, a viewer's right-hand side appearing in FIG. 1 is referred to as a front side of the laser printer 1, and a left-hand side in FIG. 1 opposite from the front side is referred to as a rear side. A side which corresponds to the viewer's nearer side is referred to as left, and an opposite side from the left, which corresponds to the viewer's farther side is referred to as right. The up-down direction in FIG. 1 corresponds to a vertical direction of the laser printer 1. Further, directions of the drawings in FIGS. 2-11 are similarly based on the orientation of the laser printer 1 as defined above and correspond to those with respect to the laser printer 1 shown in FIG. 1 even when the laser printer 1 and the components are viewed from different angles. A front-to-rear or rear-to-front direction is defined as a direction of depth and may be referred to as a front-rear direction. A right-to-left or left-to-right direction of the laser printer 1 may also be referred to as a right-left direction or a widthwise direction.

[Overall Configuration of the Laser Printer]

As shown in FIG. 1, the laser printer 1 includes a body 2, a feeder unit 3 to feed sheets S, and an image forming unit 4 to form an image on the sheet 2. The body 2 includes a chassis 21, a top cover 22, and a front cover 23. The chassis 21 includes a pair of lateral frames 21A, which are arranged to face each other along the widthwise direction, and a front panel 21B, which forms a part of a front wall of the chassis 21.

The paired lateral frames 21A are disposed to be spaced apart from each other along the widthwise direction and interpose the image forming unit 4 in there-between. Each of the lateral frames 21A is shaped in a seamless single piece. Each of the lateral frames 21A may be, for example, made of a resin injected in a mold pattern. On a surface of each lateral frame 21A facing the image forming unit 4, a guide 21G to guide a processing cartridge 6 when the processing cartridge 6 is installed in and removed from the body 2 of the laser printer 1 is formed. The processing cartridge 6 will be described later in detail.

The front panel 21B is disposed to bridge a gap between front edges of the paired lateral frames 21A. In this regard, the front panel 21B is shorter in the vertical direction than height of the lateral frames 21A, and a lower edge B1 of the front panel 21B is in an upper position with respect to lower edges of the lateral frames 21A. Therefore, on the front side of the chassis 21, an inlet 21C being an opening, through which the sheet S to be fed can be inserted, is formed in a lower position on the front face formed by the lateral frames 21A and the front panel 21B. More specifically, an upper edge of the inlet 21C coincides with the lower edge B1 of the front panel 21B, and a lower edge of the inlet 21C is formed of a part of a feeder tray 31. The feeder tray 31 will be described later in detail. Each lateral edge of the inlet 21C is formed of a part of the lateral frames 21C. In this regard, the lower edge B1 of the front panel 21B indicates a lower and front edge of the front panel 21B, which faces a sheet placement board 31A being in a standby position. The sheet placement board 31A and the standby position thereof will be described later in detail.

The chassis 12 further has an upward opening (not shown), which is exposed by rotating the top cover 22. The top cover 22 is rotatably supported by the chassis 21 to rotate about a rotation axis 22A, which is arranged on a rear end of the chassis 21. An upper plane of the top cover 22 forms an ejection tray 9, on which the sheet S ejected out of the chassis 21 by an ejection roller 8 is placed. The ejection roller 8 will be described later in detail. The ejection tray 9 includes an extendable cover 10. The extendable cover 10 is rotatable with respect to the top cover 22 to move between a closed position, where the extendable cover 10 lies over the ejection tray 9, and an open position, where the extendable cover 10 adjoins the ejection tray 9 supporting a front part of the sheet S when the sheet S is on the ejection tray 9. The closed position and the open position of the extendable cover 10 are indicated by a dash-and-double-dotted line and a solid line in FIG. 1, respectively.

The front cover 23 covers a part of the front face of the chassis 21, in particular, a front side of the front panel 21B, and is rotatably supported by the chassis 21 at a lower end thereof. Thus, by rotating the front cover 23 frontward about the lower end, the inlet 21C of the chassis 21 is exposed, and by rotating the front cover 23 rearward about the lower end, the inlet 21C of the chassis 21 is covered.

The feeder unit 3 is disposed in a lower position in the body 2. The feeder unit 3 includes the feeder tray 31, a manual-feeder tray 100, and a sheet-feeding mechanism 32. On the feeder tray 31, the sheet S inserted through the lower part of the inlet 21C is placeable. On the manual feeder tray 100, the sheet S inserted through the upper part of the inlet 21C is placeable. The sheet-feeding mechanism 32 conveys the sheet S placed on the feeder tray 31 toward the image forming unit 4.

The feeder tray 31 includes the front cover 23 and a sheet placement board 31A, which is arranged in a lower position inside the chassis 21. More specifically, the feeder tray 31, with the front cover 23 rotated frontward and laid flat, is extended outward from the chassis 21 with respect to the inlet 21C. The sheet placement board 31A forms an inner part of the feeder tray 31 arranged inside the chassis 21 while the front cover 23, when rotated frontward to expose the inlet 21C, forms an outer part of the feeder tray 31 arranged outside the chassis 21. In this regard, the position of the outer part of the feeder tray 31 outside the chassis 21 refers to a frontward position with respect to the sheet placement board 31A and to the front edges of the lateral frames 21A.

The sheet placement board 31A is arranged inside the chassis 21 and ranges from the front end of the chassis 21 to a position in the vicinity of the rear end of the chassis 21. The sheet placement board 31A is rotatable about a rotation axis at the front end thereof to move the rear end thereof upward and downward. In a position underneath the sheet placement board 31A, a lifting member 31B, which is rotatable about a rotation axis 31C, is disposed. When the lifting member 31B is rotated by a known movable mechanism and a controller (not shown), the sheet placement board 31A is uplifted at the rear end thereof to be closer to and farther from a pickup roller 32A, which will be described later in detail.

When no instruction for printing is given, the lifting member 31B is not moved but is maintained flat. Thus, the sheet placement board 31A is in a standby position, where the sheet placement board 31A lies horizontally at a farthest possible position from the pickup roller 32A, as indicated by a dash-and-double-dotted line in FIG. 1. Meanwhile, when the instruction for printing is given, the sheet placement board 31A is uplifted by the lifting member 31B to rotate upward to be closer to the pickup roller 32A so that the sheet S placed on the feeder tray 31 is uplifted toward the pickup roller 32A.

Meanwhile, the manual-feeder tray 100 is disposed in an upper position with respect to the feeder tray 31 and guides a leading end of the sheet S placed thereon toward the pickup roller 32A. The manual-feeder tray 100 will be described later in detail.

The feeder mechanism 23 includes the pickup roller 32A, a separator roller 32B, and a separator pad 32C. The pickup roller 32A is disposed on a rear side of the chassis 21 in a position opposite from the front cover 23 across the inlet 21C. More specifically, the pickup roller 32A is disposed in an upper position with respect to the rear end of the sheet placement board 32A. The separator roller 32B is disposed in a downstream position with respect to the pickup roller 32A along a direction of conveying the sheet S and faces the separator pad C.

With the feeder unit 3 and the front cover 23 being rotated frontward to form the feeder tray 31, the sheet S can be inserted through the inlet 21C and placed on the feeder tray 31 or on the manual-feeder tray 100. When the instruction for printing is given, the rear end of the sheet placement board 31A is uplifted, and the sheet S placed on the feeder tray 31 or the manual-feeder tray 100 contacts the pickup roller 32A. With the sheet S being in contact with the pickup roller 32A, when the pickup roller 32A rotates, the sheet S on the feeder tray 31 or the manual-feeder tray 100 is conveyed to the separator roller 32B. The sheet S conveyed to the separator roller 32B is separated from other sheets S (if any) by the separator roller 32B and the separator pad 32C and fed to the image forming unit 4. Thus, a plurality of sheets S is conveyed one by one to the image forming unit 4.

The image forming unit 4 forms an image on the conveyed sheet S and includes a scanning unit 5, the processing cartridge 6, and a fixing unit 7.

The scanning unit 5 is disposed on a front side of the body 2 in an upper position with respect to the feeder unit 3 and includes a scanner plate 51, a laser emitter (not shown), a polygon mirror (not shown), and lenses (not shown). The scanning unit 5 emits a laser beam toward a photosensitive drum 6, which will be described later in detail, to scan a circumference of the photosensitive drum 61.

The scanner plate 51 supports the laser emitter, the polygon mirror, and the lenses and is fixed in a predetermined correct position with respect to the lateral frames 21A.

The processing cartridge 6 is disposed on the rear side of the body 2 in an upper position with respect to the feeder unit 3. The processing cartridge 6 is detachably attached to the chassis 21 through the opening, which is formed on the upper part of the body 2 and exposed when the top cover 22 is open. The processing cartridge 6 includes the photosensitive drum 61 and a shaft 61A thereof, which will be described later in detail, and is guided to the position on the chassis 21 as the shaft 61A of the photosensitive drum 61 is inserted in the guides 21G formed in the lateral frames 21A.

The processing cartridge 6 includes the photosensitive drum 61, a transfer roller 62 disposed to face the photosensitive drum 61, a charger (unsigned), a developer roller 63, and a toner container (not shown).

In the processing cartridge 6, the circumference of the photosensitive drum 61 is electrically charged evenly by the charger as the photosensitive drum 61 rotates and is selectively exposed to the laser beam emitted from the scanning unit 5. Thereby, potential in the exposed areas on the circumference is lowered, and a latent image is formed on the circumference of the photosensitive drum 61. The latent image formed on the circumference of the photosensitive drum 61 is supplied with toner contained in the toner container, and the image is developed to be a toner image. While the sheet S is conveyed to a position between the photosensitive drum 61 and the transfer roller 62, the toner image carried on the circumference of the photosensitive drum 61 is transferred to the sheet S.

The fixing unit 7 is disposed on the rear side in the body 2 in an upper position with respect to the processing cartridge 6 and includes a heat roller 71 and a pressure roller 72. The heat roller 71 contains a heat source such as a halogen lamp and heats the sheet S. The pressure roller 72 nips the sheet S in conjunction with the heat roller 71 and is disposed in an upper-rear position with respect to the heat roller 71. In the fixing unit 7, the toner transferred to the sheet S is thermally fixed thereat as the sheet S passes through an intermediate position between the heat roller 71 and the pressure roller 72. The sheet S with the fixed toner thereon is conveyed by the ejection roller 8, which is disposed in a downstream position with respect to the fixing unit 7 along the direction of conveying the sheet S, and ejected on the ejection tray 9.

[Detailed Configuration of the Manual-Feeder Tray and Periphery Thereof]

Next, detailed configuration of the manual-feeder tray 100 and components surrounding the manual-feeder tray 100 will be described.

As shown in FIG. 1, the manual-feeder tray 100 includes a main part 110, which includes a first guiding part 111 and a second guiding part 112. The first guiding part 111, when the manual-feeder tray 100 is installed in the laser printer 1, is arranged in a position between the front cover 23 and the pickup roller 32A extending along the front-rear direction. The second guiding part 112 extends from an end of the first part 111 closer to the pickup roller 32A along the front-rear direction toward the pickup roller 32A. The second guiding part 112 therefore forms one end of the manual-feeder tray 100 along the front-rear direction closer to the pickup roller 32A.

More specifically, the main part 110 of the manual-feeder tray 100 is formed in a two-parted angled shape with respect to the front-rear direction. The first guiding part 111 spreads substantially horizontally along an upper plane 311 of the sheet placement board 31A in the standby position. The standby position of the sheet placement board 31A is indicated by the dash-and-double-dotted line in FIG. 1. The second guiding part 112 spreads toward the pickup roller 32A inclining lower-rearward to be closer to the upper plane 311 of the sheet placement board 31A. The manual-feeder tray 100 thus guides the leading end of the sheet S placed thereon to a position above the rear end of the sheet placement board 31A.

Figure 2:
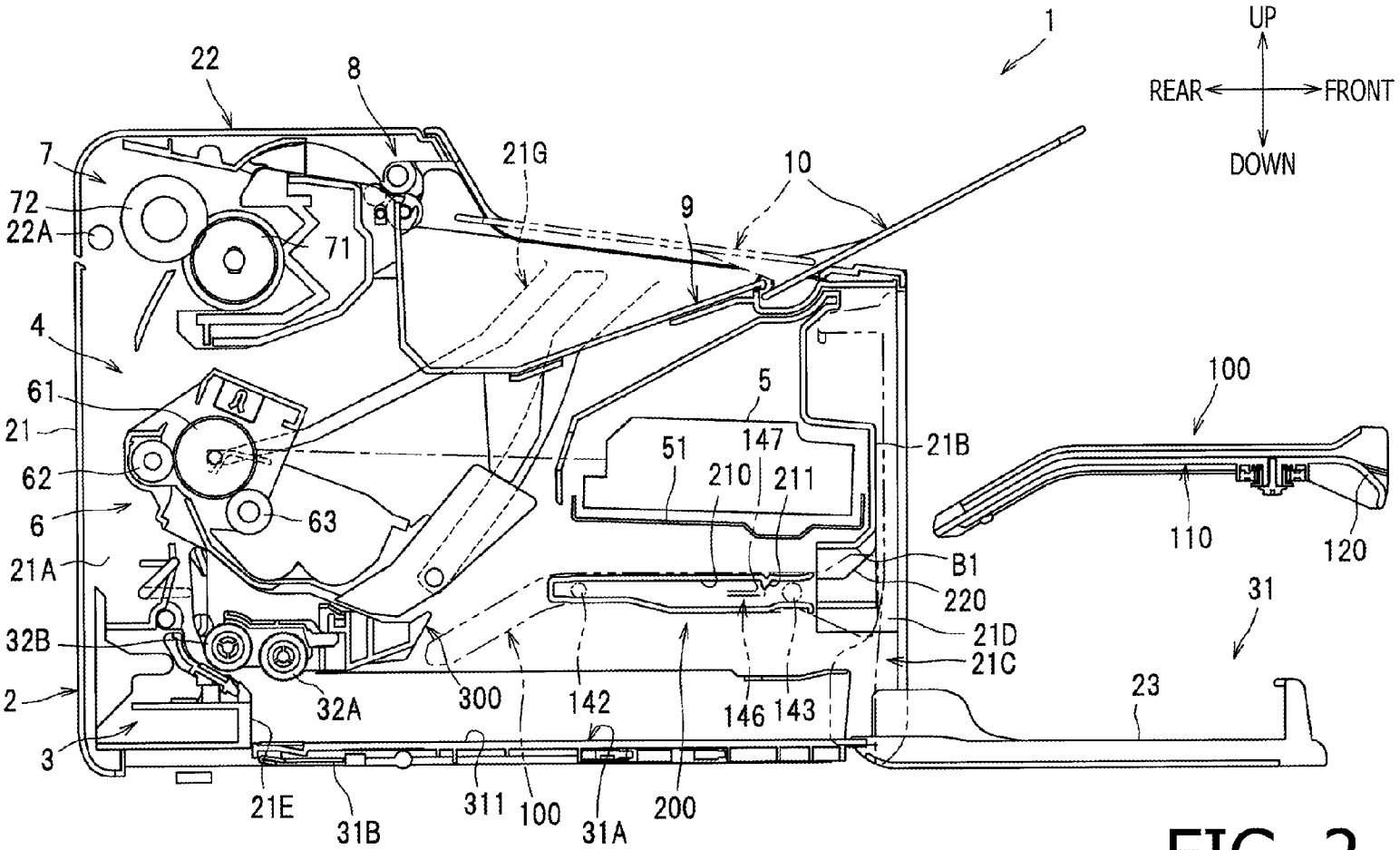
FIG. 2 is a cross-sectional side view of the laser printer according to the embodiment of the present invention with the manual-feeder tray being removed therefrom.

The manual-feeder tray 100 includes a handgrip 120, which is formed to protrude from an end of the main part 110 closer to the inlet 21C, i.e., from a front end of the main part 110, toward the front cover 23 through the inlet 21C. In other words, the handgrip 120 protrudes to be closer to the front cover 23 beyond the inlet 21C. A user may grip the handgrip 120 to move the manual-feeder tray 100 along the front-rear direction, and as shown in FIG. 2, the manual-feeder tray 100 is attached to and removable from the chassis 21 through the inlet 21C.

Meanwhile, the chassis 21 includes rails 200, which guide the manual-feeder tray 100 to be attached, and a restrictive wall 21E, which restricts a position of the leading edge of the sheet S placed on the feeder tray 31. The chassis 21 further includes a holder frame 300. The holder frame 300 forms a part of the chassis 21 to support rotatable parts including the pickup roller 32A.

Figure 3:
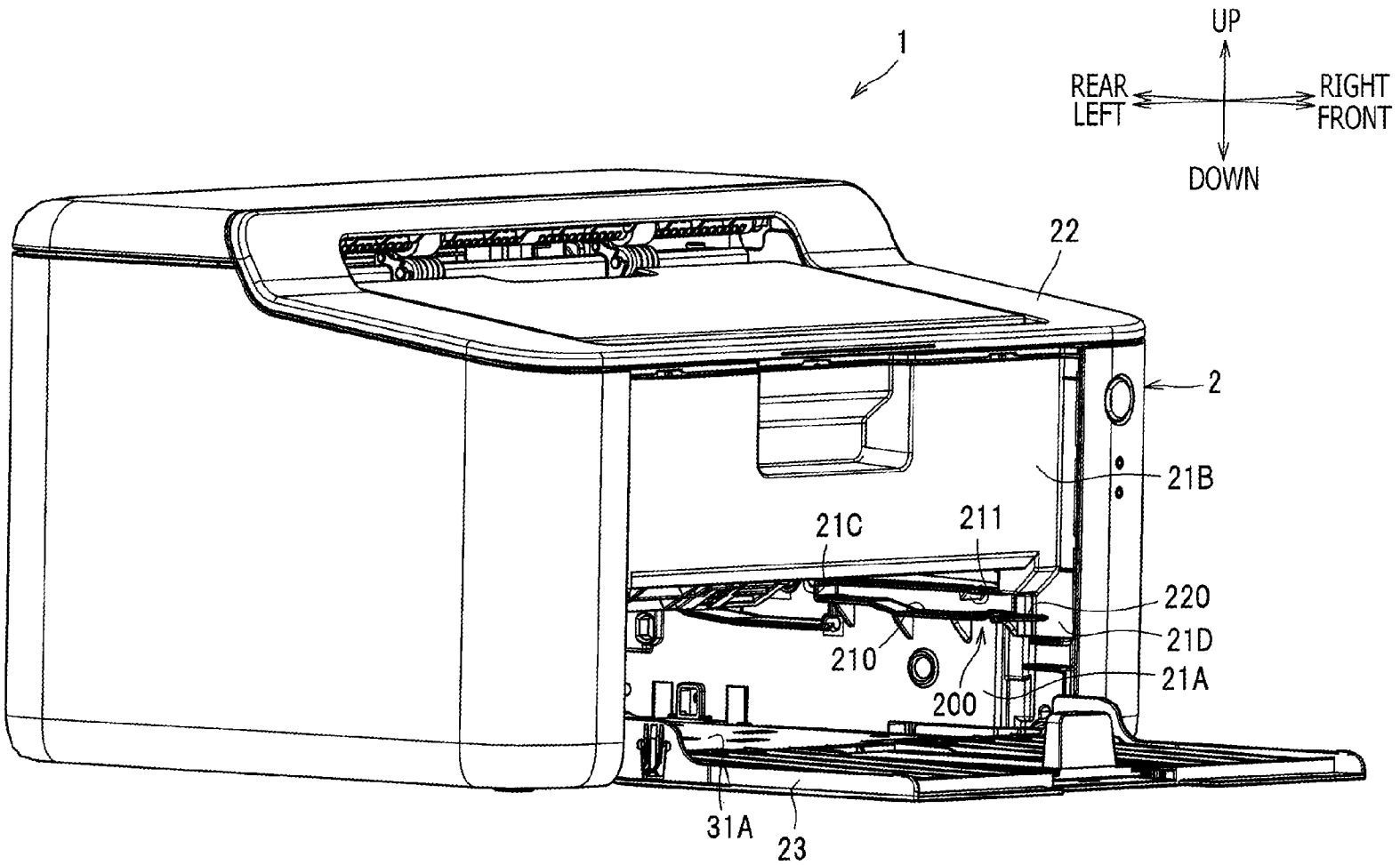
FIG. 3 is a perspective view of the laser printer according to the embodiment of the present invention with the manual-feeder tray being removed therefrom.

The rails 200 are formed to have ribs, which protrudes inward from inner planes of the chassis 21, and extend longitudinally along the front-rear direction inside the chassis 21. Each of the rails 200 includes, as shown in FIG. 3, a first rail 210, which is formed on an inner surface of the lateral frame 21A, and a second rail 220, which is formed of a part the front panel 21B. In other words, the rail 200 is formed continuously over the lateral frame 21A and the front panel 21B.

More specifically, the first rail 210 is formed in a frontward position with respect to the holder frame 300 along the front-rear direction and in a position between the scanning unit 5 and the sheet placement board 31A along the vertical direction. The first rail 210 is formed in a cross-sectional shape of a flattened "C" or a turned-over "U", which is open frontward and closed at a rear end thereof. The first rail 210 includes a stopper 211, which protrudes downward from an upper-inner surface thereof.

The second rail 220 is formed in a frontward position with respect to each of the first rails 210. In other words, the second rail 220 forms the front end of the rail 200. The front panel 21B has an extended part 21D, which extends downward from a lower edge of the inlet 21C, at each widthwise end thereof, and the second rail 220 is formed on the extended part 21D.

As shown in FIG. 2, the restrictive wall 21E is arranged on an opposite side with respect to the lifting member 31B from the front cover 23 across the inlet 21C along the front-rear direction to contact the leading end of the sheet S placed on the feeder tray 31. The restrictive wall 21E spans along a direction orthogonal with respect to the upper plane 311 of the sheet placement board 31A in the standby position.

[Detailed Configuration of the Manual-Feeder Tray]

Figure 4:
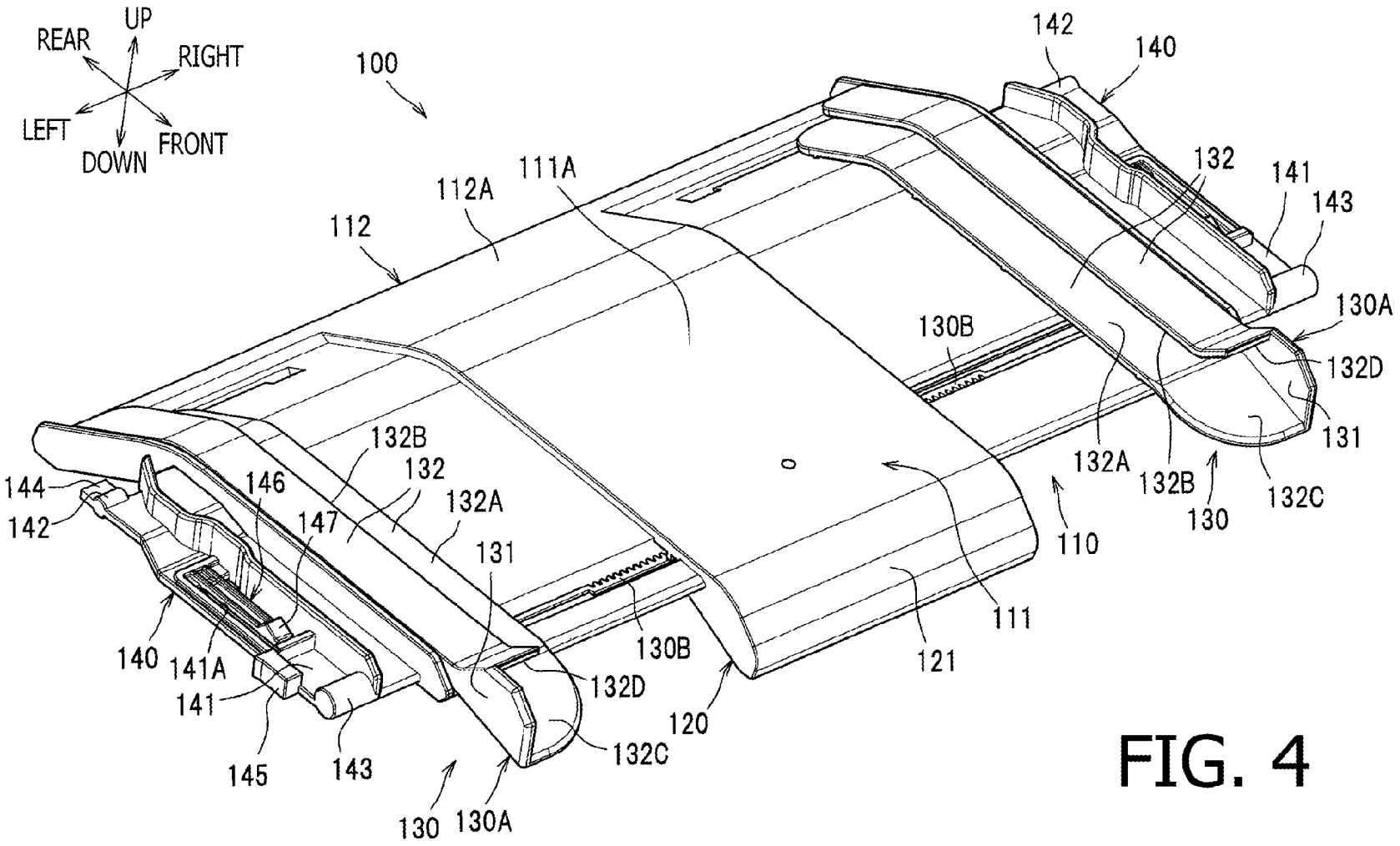
FIG. 4 is a perspective upper-side view of the manual-feeder tray of the laser printer according to the embodiment of the present invention.

The manual-feeder tray 100 includes, as shown in FIG. 4, the main part 110, the handgrip 120, a pair of lateral guides 130 disposed on the main part 110, and a pair of guided pieces 140 disposed at widthwise ends of the main part 110.

The main part 110 is formed as a piece of plate and includes the first guiding part 111 and the second guiding part 112. The main part 110 is angled at a boundary position between the first guiding part 111 and the second guiding part 112.

The first guiding part 111 includes a first guiding surface 111A, which forms a step being higher than other neighboring parts, on an upper plane thereof at a widthwise center of the first guiding part 111, i.e., at a central area along a widthwise direction of the sheet S placed on the manual-feeder tray 100. Therefore, the sheet S placed on the manual-feeder tray 100 contacts the first guiding surface 111A at a lower surface thereof. The first guiding surface 111A is formed to range between the front end and the rear end of the first guiding part 111.

The second guiding part 112 includes a second guiding surface 112A, which forms a step being higher than other neighboring parts, on an upper plane and at a widthwise center thereof. The second guiding surface 112A extends continuously from a rear end of the first guiding surface 111A rearward along the inclination of the second guiding part 112.

The handgrip 120 is formed at a widthwise center of the main part 110, in particular, at a widthwise position equivalent to the widthwise position of the first guiding surface 111A. The handgrip 120 is formed in a shape that leans lower-frontward from the main part 110. Therefore, an outer plane 121 being an upper plane of the handgrip 120 spreads lower-frontward from the front end of the first guiding surface 111A. In other words, the outer plane 121 of the handgrip 120 spreads upper-rearward from a front end of the handgrip 120, which is an opposite and farther end from the end of the handgrip 120 closer to the main part 110 and is in a lower position with respect to the first guiding surface 111A, toward the first guiding surface 111A to reach the first guiding surface 111A. With the inclination of the handgrip 120, the sheet S being inserted through the inlet 21C is guided on the outer plane 121 of the handgrip 120 and can be easily placed on the manual-feeder tray 100.

The paired lateral guides 130 are disposed on widthwise ends of the main part 110. Each of the lateral guides 130 includes a guiding piece 130A and a lack gear 130B. The guiding piece 130A is formed in an elongated shape along the front-rear direction and extends along the upper planes of the first guiding part 111 and the second guiding part 112. The guiding piece 130A is formed to have cross-sectional shape of a bracket and includes a first restrictive part 131, which stands orthogonally with respect to the first guiding part 111 and the second guiding part 112, and a paired second restrictive parts 132, which protrudes inward along the widthwise direction from an upper end and a lower end of the first restrictive part 131.

The paired guiding pieces 130A hold the sheet S placed on the manual-feeder tray 100 at both widthwise sides, and as the first restrictive parts 131 contact widthwise ends of the sheet S, a widthwise position of the sheet S on the manual-feeder tray 100 is restricted. At the same time, as the second restrictive parts 132 hold the sheet S in there-between vertically, an upward surface 132A of a lower one of the second restrictive parts 132 contacts the lower surface of the sheet S, and a downward surface 132B of an upper one of the second restrictive parts 132 contacts the upper surface of the sheet S. Thus, a vertical position of the sheet S on the manual-feeder tray 100 is restricted. In other words, the paired guiding pieces 130A restrict the widthwise position of the sheet S on the manual-feeder tray 100 by the first restrictive parts 131 and the vertical position of the sheet S, along a direction of thickness of the sheet S, by the second restrictive parts 132.

Meanwhile, as shown in FIG. 4, front portions of the first restrictive part 131 and the second restrictive part 132 protrude frontward with respect to the first guiding part 111 of the main part 110. In other words, the first restrictive part 131 and the second restrictive part 132 protrude further to be closer to the front cover 23 than the one end (i.e., the front end) of the main part 110 closer to the front cover 23. In particular, the lower one of the second restrictive parts 132 protrudes to be closer to the front cover 23 than the inlet 21C. Thereby, when the user inserts the sheet S to place on the manual-feeder tray 100, the sheet S can be easily inserted inside the lateral guides 130.

In this regard, an amount of a gap between the paired second restrictive parts 132 of each guiding part 130 increases toward the front side as the second restrictive parts 132 closer to the front cover 23. Thereby, the sheet S can be inserted in the enlarged gap between the paired second restrictive parts 132 even more easily.

In particular, the upward surface 132A of the lower one of the second restrictive parts 132 includes a first draw-in surface 132C, which protrudes frontward with respect to the front end of the main part 110. Meanwhile, the downward surface 132B of the upper one of the second restrictive parts 132 includes a second draw-in surface 132D, which protrudes frontward with respect to the front end of the main part 110. In this regard, the upward surface 132A of the lower one of the second restrictive part 132 is in a substantially in a same height as the first guiding surface 111A of the first guiding part 111.

The first draw-in surface 132C extends with inclination with respect to the second restrictive part 132 from a lower position with respect to the upward surface 132A of the lower second restrictive part 132 upper-rearward toward the upward surface 132A to reach the upward surface 132A. Meanwhile, the second draw-in surface 132D extends in inclination with respect to the second restrictive part 132 from a higher position with respect to the downward surface 132B of the upper second restrictive part 132 lower-rearward toward the downward surface 132B to reach the downward surface 132B.

Figure 5:
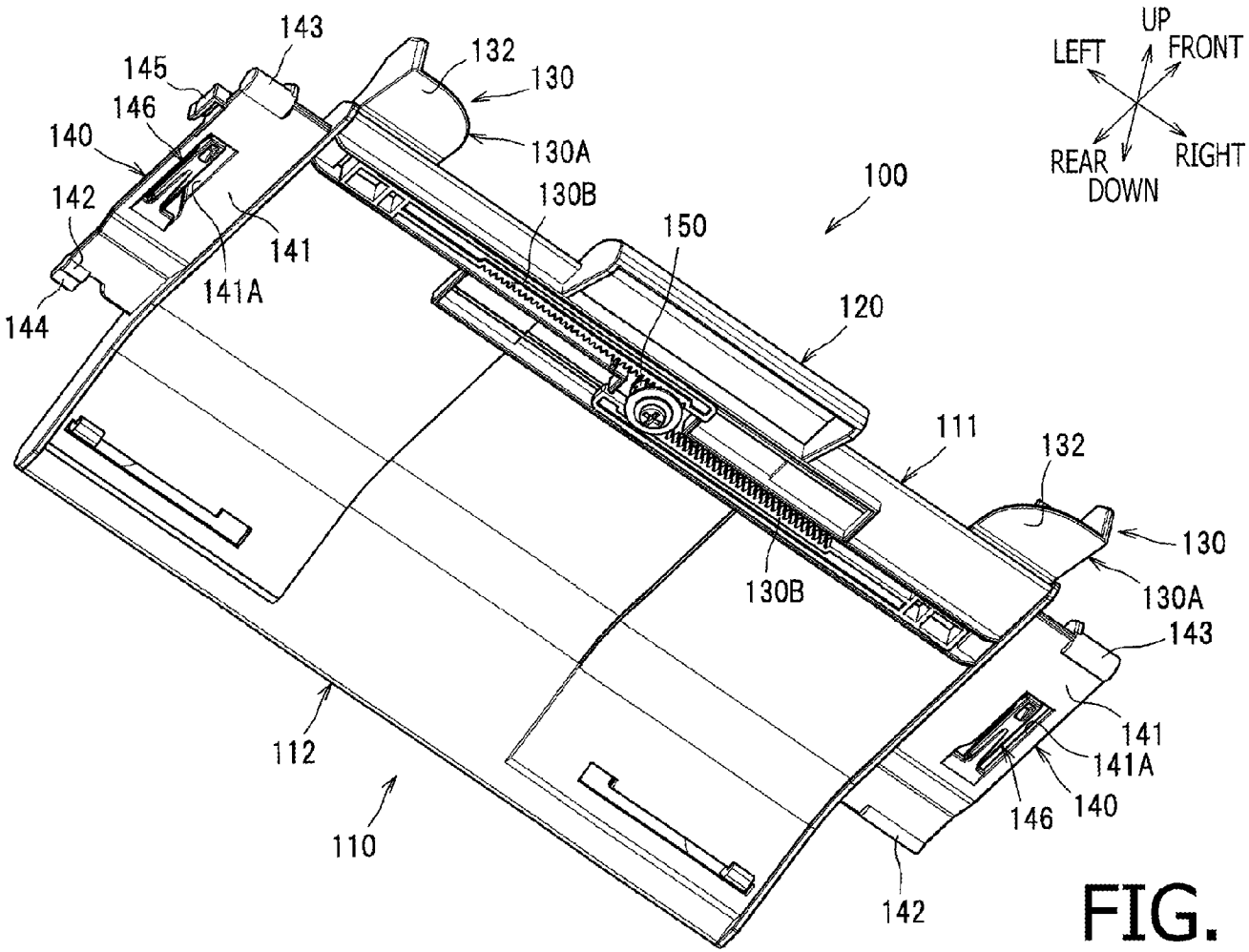
FIG. 5 is a perspective lower-side view of the manual-feeder tray of the laser printer according to the embodiment of the present invention.

Each of the paired rack gears 130B, as shown in FIG. 5, extends from a lower part of the guiding part 130A, penetrates the main part 110 through an opening (unsigned) formed in the main part 110 to reach the lower plane of the main part 110, and further extends inward along the widthwise direction. The rack gear 130B is formed to have gear teeth on a side, which faces the other one of the paired rack gears 130B, and the paired rack gears 130B are engaged with a pinion gear 150, which is fixed to the main part 110 in a position between the paired rack gears 130B. Therefore, when one of the paired lateral guides 130 is moved along the widthwise direction to fit with a size of the sheet S, the other one of the paired lateral guides 130 is moved along the widthwise direction according to rotation of the pinion gear 150. Thus, the sheet S placed on the main part 110 is interposed between the guiding pieces 130A along the widthwise direction to be placed in the widthwise central position on the manual-feeder tray 100.

Each of the guided pieces 140 includes a coupler part 141, which extends laterally outward from a lateral end of the main part 110, a first cylinder 142, which is formed at a rear end of the coupler part 141, and a second cylinder 143, which is formed at a front end of the coupler part 141. One of the paired guided pieces 140 on the left-hand side further includes a first positioning part 144 and a second positioning part 145.

Each of the guided pieces 141 is, as shown in FIG. 4, formed to have an opening 141A in a central area of the guided piece 141 along the front-rear direction. Inside the opening 141A, an engageable arm 146 is arranged. The engageable arm 146 extends from a rear edge of the opening 141A frontward and has a triangular projection 147 at a front end thereof. The engageable arm 146 is resiliently deformable at a basal end, which is a rear end, and is swingable up-and-down at a front end thereof about the basal end.

Each of the first cylinder 142 and the second cylinder 143 is formed in a shape of a cylinder, of which axis align along the widthwise direction. A diameter of the second cylinder 143 is greater than a diameter of the first cylinder 142.

The first positioning part 144 is formed at a rear end of the coupler part 141. The first positioning part 144 is formed in a shape of a thin plate spreading rearward from a circumference of the first cylinder 142.

The second positioning part 145 is formed at a left-side end of a front portion of the coupler part 141. Thus, the second positioning part 145 is arranged in a displaced position with respect to the first positioning part 144 along the front-rear direction, which is an attaching direction to attach the manual-feeder tray 100 to the chassis 21. The second positioning part 145 is formed to have a shape of a hook, which extends from the coupler part 141 laterally outward and bent to extend rearward (see also FIG. 5). A tip end of the second positioning part 145 is further bent to be wider at the rear end.

Thus, with the first cylinder 142 and the second cylinder 143 of the guided part 140 being inserted in the rail 200, the manual-feeder tray 100 configured as above is, as indicated in the dash-and-double-dotted line in FIG. 2, supported by the rails 200 formed on the chassis 21, and thereby attached to the chassis 21. Meanwhile, the projection 147 of the engageable arm 146 contacts the stopper 211 from the rear side, i.e., from an upstream side along a direction of removing the manual-feeder tray 100 (see FIG. 2); therefore, the manual-feeder tray 100 is restricted from slipping out of the chassis 21 unintentionally. Placement of the manual-feeder tray 100 in a correct position with respect to the chassis 21 will be described further in detail later.

Figure 6:
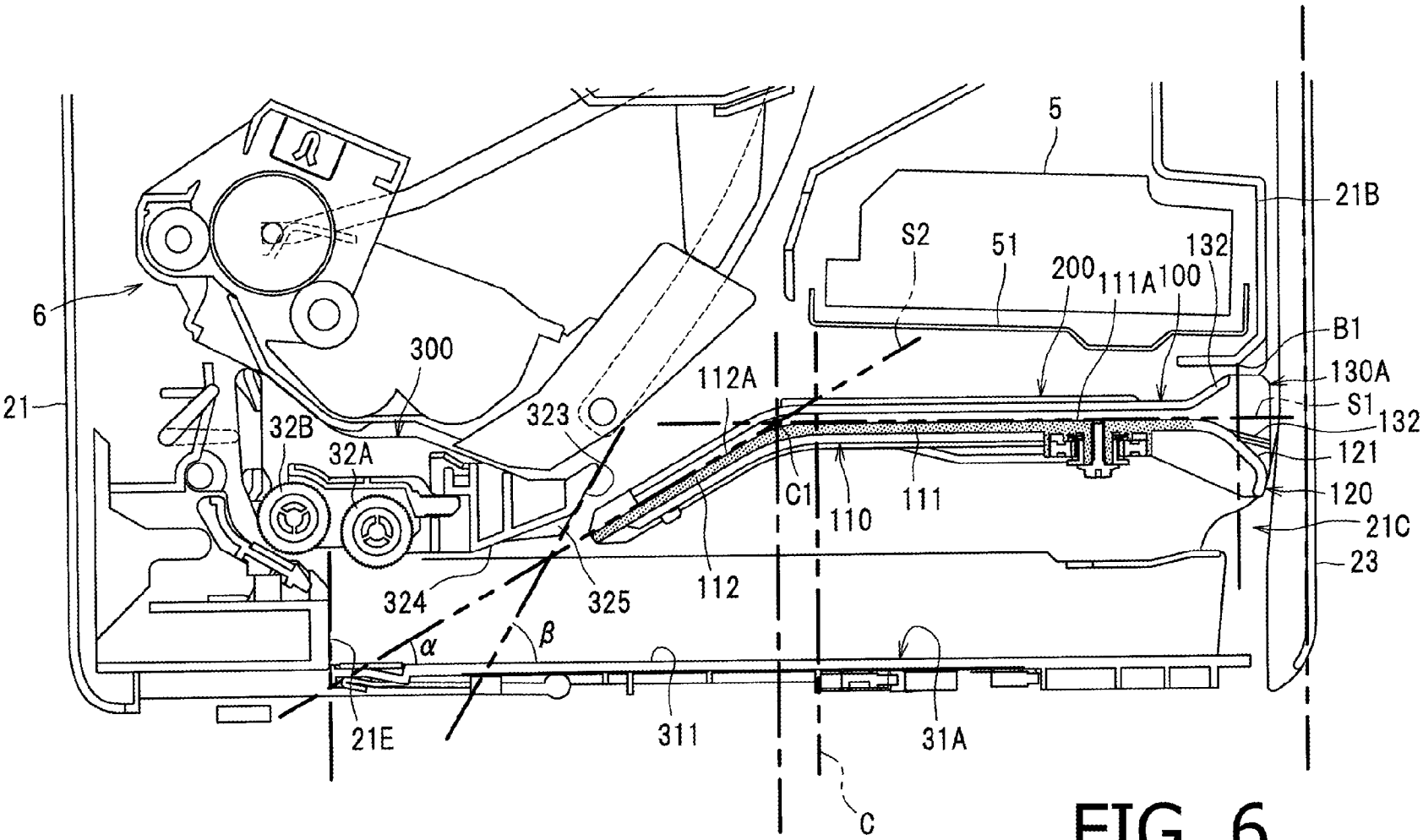
FIG. 6 is a cross-sectional side view of the laser printer to illustrate a shape of the manual-feeder tray according to the embodiment of the present invention.
Figure 7:
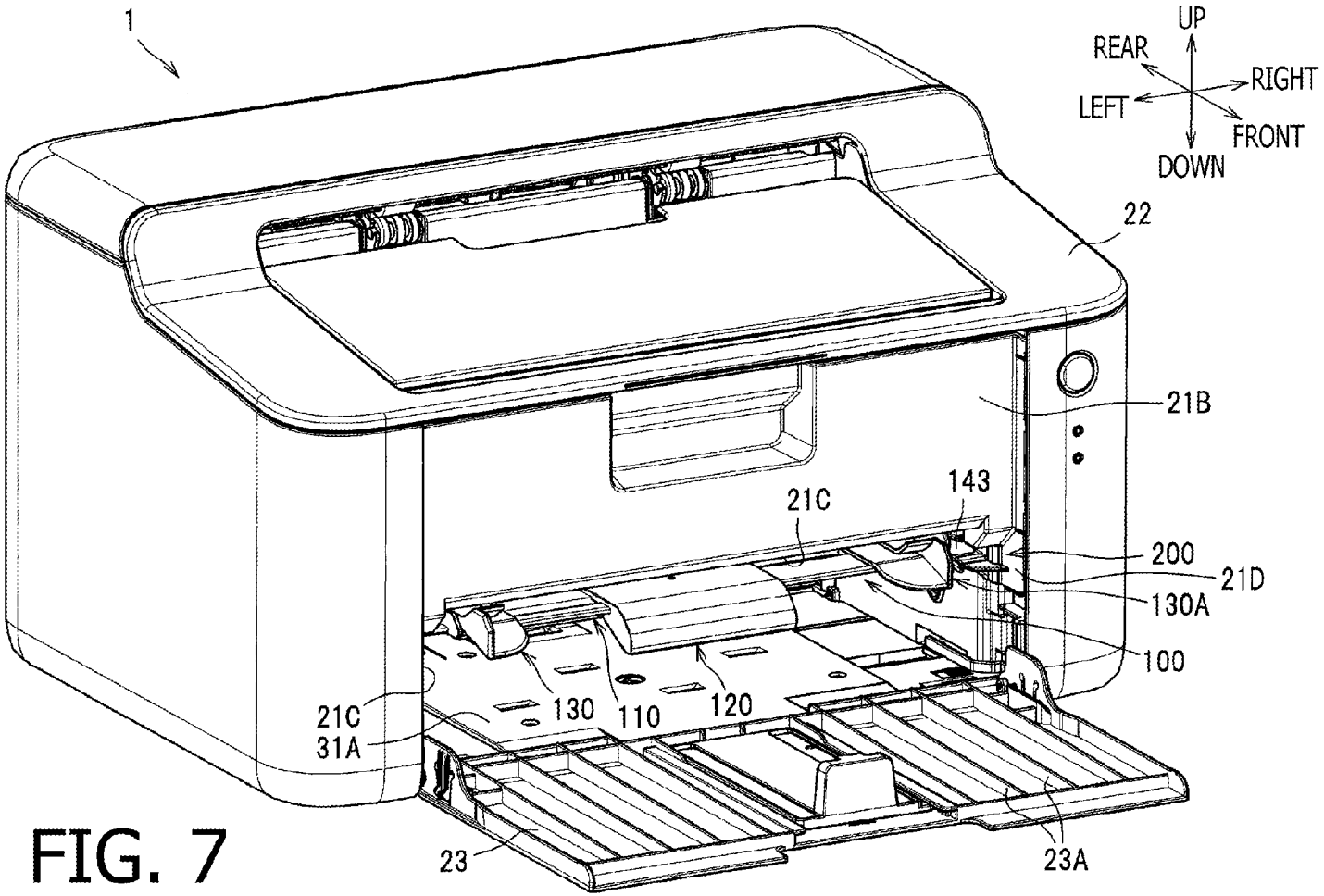
FIG. 7 is a perspective view of the laser printer according to the embodiment of the present invention with a front cover being open.

As shown in FIG. 6, in which the main part 110 of the manual-feeder tray 100 is indicated by hatching, while the manual-feeder tray 100 is attached to the chassis 21, the first guiding part 111 of the main part 110 is placed in an inner position in the chassis 21 with respect to the inlet 21C, i.e., in a rearward position with respect to the front cover 23. More specifically, one end of the first guiding part 111 along the front-rear direction closer to the front cover 23 is arranged in an opposite position from the front cover 23 across the inlet 12C. In other words, the one end of the first guiding part 111 closer to the front cover 23 is arranged on an inner side with respect to the inlet 21C. In this regard, the first guiding plane 111A of the first guiding part 111 is arranged in an upper position along the vertical direction with respect to the pickup roller 32A.

Meanwhile, one end of the second guiding part 112 closer to the pickup roller 32A, i.e., a tip end of the second guiding part 112, is arranged in a position closer to the inlet 21C with respect to the pickup roller 32A. In this regard, the sheet placement board 31A is arranged in a position on an extension line along the second guiding surface 112A of the second guiding part 112.

An extension plane S1 extending from the first guiding plane 111A and an extension plane S2 extending from the second guiding part 112 intersect with each other at a position C1. The intersection C1 is arranged in a rearward position with respect to a center along the front-rear direction of an inner space in the chassis 21 inside the inlet 21C. In other words, the intersection C1, where the first extension plane 51 and the second extension plane S2 intersect with each other, is in a rearward eccentric position closer to the rear end of the sheet placement board 31A with respect to the center C between the inlet 21C formed in the chassis 21 and the rear end of the sheet placement board 31A in the standby position.

In this regard, the handgrip 120 and the paired second restrictive parts 132 of the lateral guides 130 protrude outside the chassis 21 through the inlet 21C. With the handgrip 120 protruding outward to be closer to the front cover 23 with respect to the inlet 21C, while ribs 23A are formed to protrude inward from an inner surface of the front cover 23 (when the front cover 23 is closed), the ribs 23A are formed in displaced positions from the handgrip 120 to avoid interference with the handgrip 120 (see FIG. 7). More specifically, the ribs 23A of the front cover 23 are arranged in different positions from the handgrip 120, when the front cover 23 covers the inlet 32C, along an aligning direction, in which the front cover 23 and the inlet 21C align with each other, i.e., along the front-rear direction (see also FIG. 9).

[Detailed Configuration of the Supporting Frame]

Figure 8:
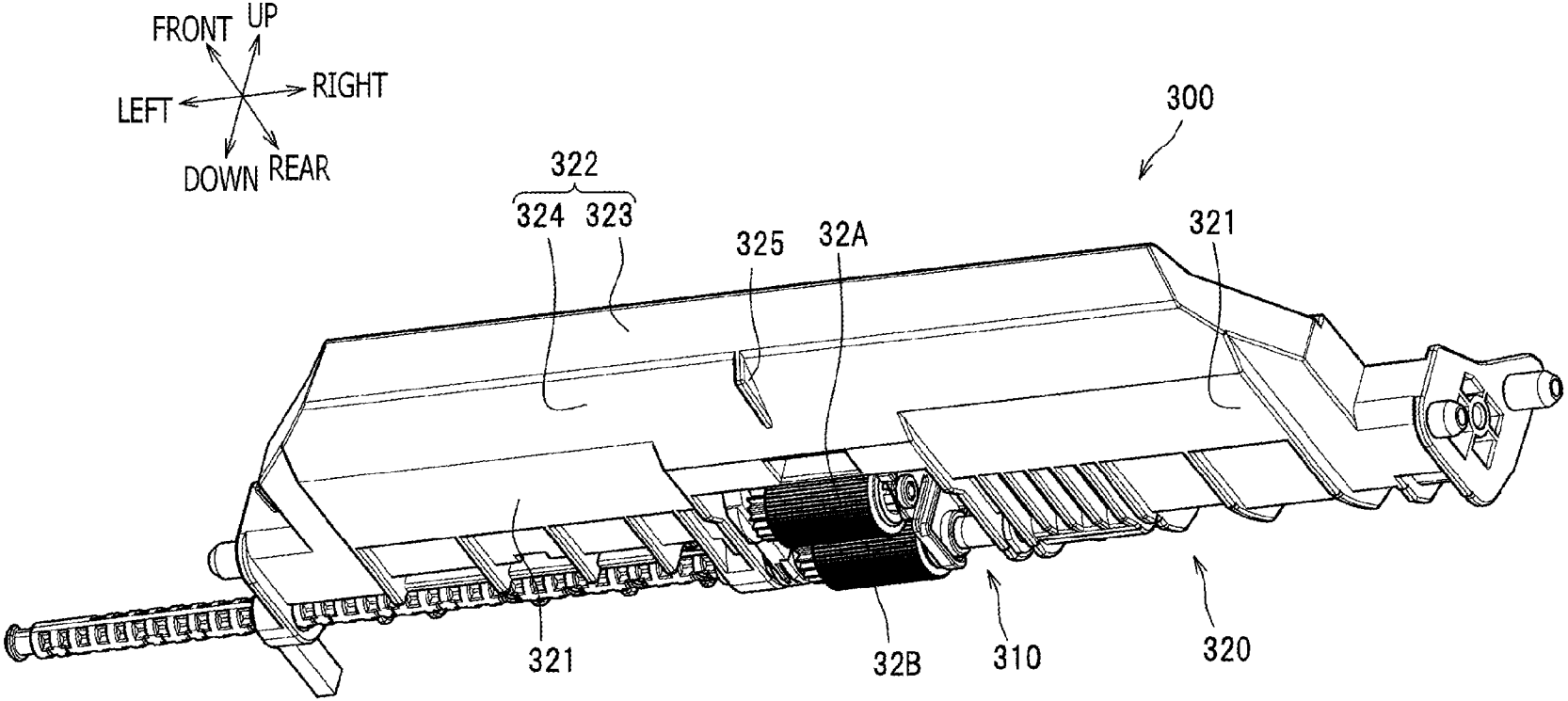
FIG. 8 is a perspective lower-side view of a holder frame in the laser printer according to the embodiment of the present invention.

As shown in FIG. 8, the holder frame 300 is formed to have a roller hosing 310 in a widthwise central area thereof. The roller housing 310 forms a room, which is exposed downward through an opening, and in which pickup roller 32A and the separator roller 32B are disposed. The pickup roller 32A and the separator roller 32B arranged inside the roller housing 310 are rotatably supported by the holder frame 300 through bearings (unsigned) and the like. The pickup roller 32A and the separator roller 32B housed in the roller housing 310 are exposed through the opening at the bottom to protrude downward from the holder frame 300.

The holder frame 300, when installed in the chassis 21, faces the sheet placement board 31A at a lower face 320, and the lower face 320 includes opposing planes 321 and an oblique plane 322. The opposing planes 321 are formed in lateral positions with respect to the roller housing 310 along the widthwise direction and in a frontward position with respect to the pickup roller 32A along the front-rear direction. When the holder frame 300 is installed in the chassis 21, the opposing planes 321 spread along the upper plane 311 of the sheet placement board 31A in the standby position. The oblique plane 321 is formed to spread frontward from front ends of the opposing planes 321 and the roller housing 310 and incline with respect to the opposing planes 321 to be higher toward the front side of the chassis 21. In other words, the oblique plane 322 extends to be closer to the upper plane 311 of the sheet placement board 31A toward the rear side of the laser printer 1.

In particular, the oblique plane 322 includes a first guiding plane 323, which forms a front end of the holder frame 300, and a second guiding plane 324, which spreads in between the first guiding plane 323 and the opposing planes 321. In a widthwise central position on the second guiding plane 324, a projection 325 is formed.

As shown in FIG. 6, when the holder frame 300 is installed in the chassis 21, the first guiding plane 323 is arranged in between the pickup roller 32A and the second guiding part 112 of the manual-feeder tray 100 and faces the second guiding part 112. An angle β between the first guiding plane 323 and the upper plane 311 of the sheet placement board 31A in the standby position is greater than an angle α between the second guiding surface 112A of the second guiding part 112 and the sheet placement board 31A in the standby position. In this regard, an angle (unsigned) between the second guiding plane 324 and the upper plane 311 of the sheet placement board 31A in the standby position is smaller than the angle β between the first guiding plane 323 and the upper plane 311 of the sheet placement board 31A in the standby position.

The projection 325 is formed to protrude downward, when the holder frame 300 is installed in the chassis 21, from the second guiding plane 324 toward a position corresponding to a widthwise center of the sheet S on the manual-feeder tray 100. In other words, the projection 325 points at a widthwise center between the paired lateral guides 130 on the second guiding part 112 of the manual-feeder tray 100.

[Positioning Structure of the Manual-Feeder Tray]

Figure 9:
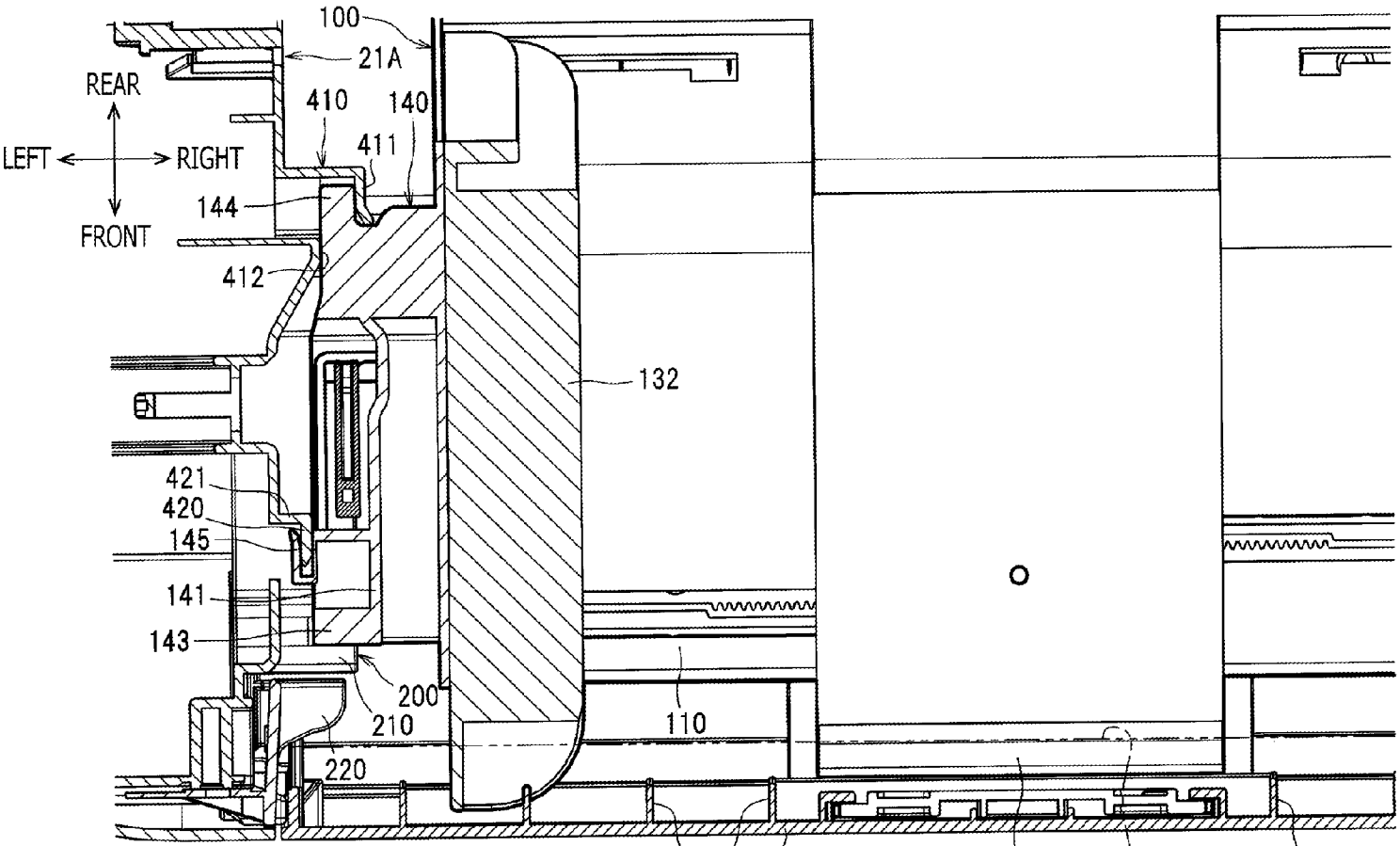
FIG. 9 is a cross-sectional view of the manual-feeder tray in the laser printer according to the embodiment of the present invention, showing a lower side of the manual-feeder tray having a first positioning part and a second positioning part.

Next, structures to install the manual-feeder tray 100 in a correct position with respect to the chassis 21 will be described with reference to FIG. 9.

In the chassis 21, on an inner side of one of the paired lateral frames 21A on the left, a first locatable part 410 and a second locatable part 420 are formed. The first locatable part 410 is engageable with the first positioning part 144 of the manual-feeder tray 100. The second locatable part 420 is engageable with the second positioning part 145 of the manual-feeder tray 100.

The first locatable part 410 forms a dent, which is open frontward, and in which the first positioning part 144 can be inserted. More specifically, the first locatable part 410 protrudes inward along the widthwise direction (i.e., rightward) from the inner surface of the lateral frame 21A on the left and is bent to extend frontward to form an engagement section 411. The first locatable part 410 thus holds the first positioning part 144 in between the engagement section 411 and the inner surface 412 of the lateral frame on the left at widthwise sides. In other words, the first positioning part 144 is wedged in the dent between engagement section 411 of the first locatable part 410 and the inner surface 412 of the lateral frame 21A on the left. Thereby, the rear end of the manual-feeder tray 100 is placed in a correct position along the widthwise direction with respect to the lateral frame 21A on the left. Further, with a tip end of the engagement section 411 being placed to contact the rear end of the coupler part 141 of the manual-feeder tray 100, the manual-feeder tray 100 is placed in a correct position along the front-rear direction with respect to the lateral frame 21A on the left.

The tip end of the engagement section 411 is bent inward along the widthwise direction to be wider toward the front side. Therefore, when the manual-feeder tray 100 is installed, the engagement section 411 can draw the first positioning part 144 rearward smoothly in between the engagement section 411 and the inner side 412 of the lateral frame 21A on the left.

Meanwhile, the second locatable part 420 is arranged in a position closer to the inlet 21C with respect to the first locatable part 410. In other words, the second locatable part 420 is in a frontward displaced position with respect to the first locatable part 410 along the direction of attaching the manual-feeder tray 100. The second locatable part 420 forms a projection including a protrusive section 421, which protrudes inward from the inner surface of the lateral frame 21A on the left, and is bent at a front end of the protrusive section 421 to extend frontward. The second locatable part 420 is wedged in the second positioning part 145 at widthwise sides. Thereby, the manual-feeder tray 100 is restricted from being moved along the widthwise direction at the front end thereof. Accordingly, the manual-feeder tray 100 is restricted from rotating about the first positioning part 144 and from being inclined with respect to an axial direction of the pickup roller 32A.

The second locatable part 420 is, further, formed in a tapered shape to be thinner toward the front side. Therefore, when the manual-feeder tray 100 is installed in the chassis 21, the second locatable part 420 can be smoothly inserted in the second positioning part 145. At the same time, while the second positioning part 145 is formed to open wider toward the rear side, the second locatable part 420 can be drawn in the second positioning part 145 even more easily.

[Positional Relation Between the Image Forming Unit and the Chassis]

Figure 10:
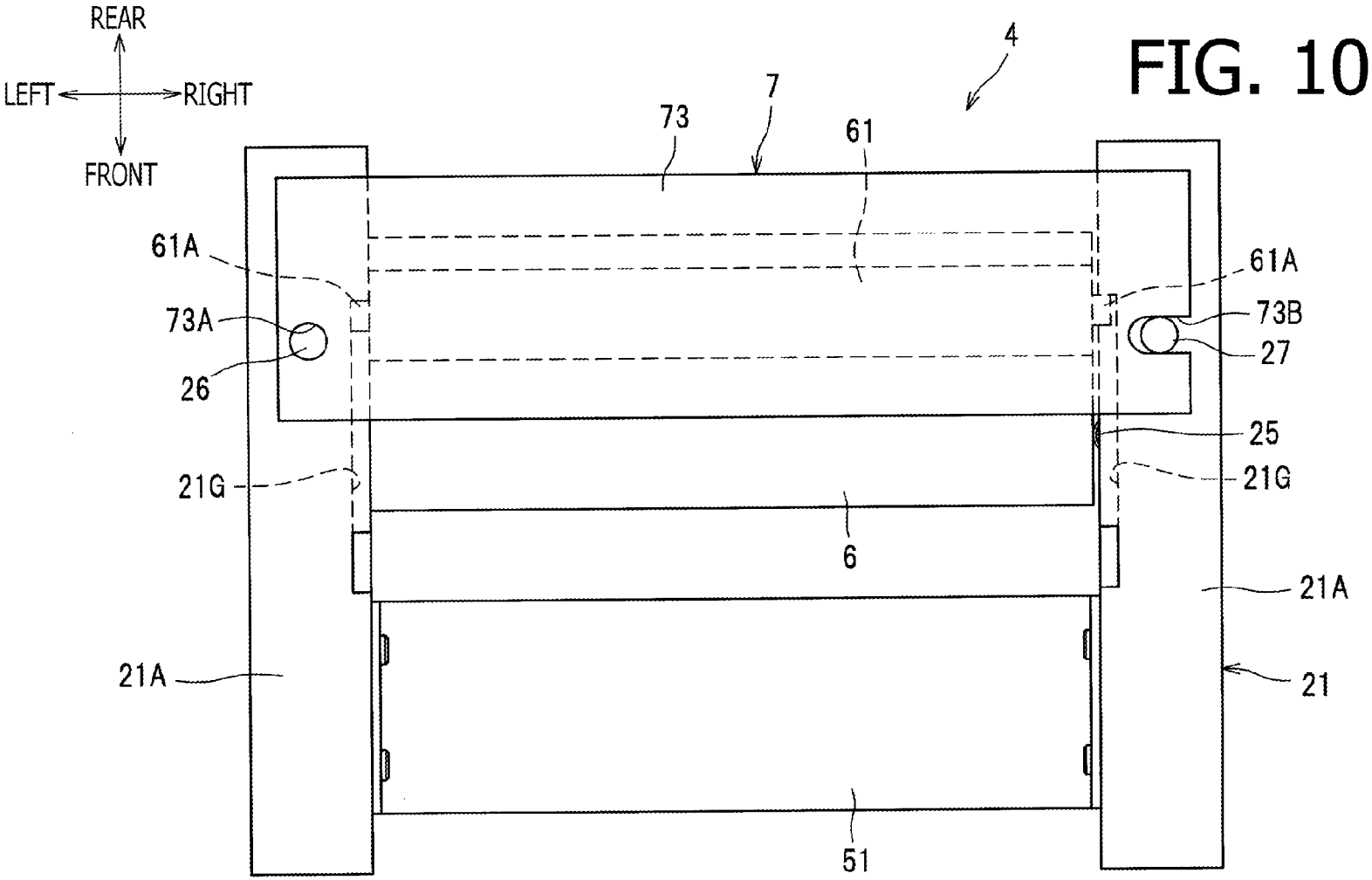
FIG. 10 is a plane view of an image forming unit and lateral frames in the laser printer according to the embodiment of the present invention viewed from above.

Next, structures to install components including the image forming unit 4 in correct positions with respect to the chassis 21 will be described with reference to FIG. 10.

The scanner plate 51 is fixed to the lateral frame 21A on the left at a leftward end thereof and to the lateral frame 21A on the right at a rightward end thereof. In other words, an amount of the gap between the paired lateral frames 21A along the widthwise direction is defined by a widthwise length of the scanner plate 51.

The processing cartridge 6 is urged against the lateral frame 21A on the left by a spring electrode 25, which is disposed on the lateral frame 21A on the right. The electrode 25 may, for example, an electrode to supply electricity to the charger. While the processing cartridge 6 is urged leftward by the electrode 25, a shaft 61A of the photosensitive drum 61 is urged against a leftward end of the guide 21G, which is formed in the lateral frame 21A on the left. Thus, the processing cartridge 6 is placed in an eccentric position to be closer to the lateral frame 21A on the left with respect to a widthwise midst position between the lateral frame 21A on the right and the lateral frame 21A on the left.

The fixing unit 7 includes a frame 73, which accommodates the heat roller 71 and the pressure roller 72. The frame 73 of the fixing unit 7 is supported by the paired lateral frames 21A. The fixing unit 7 is placed in a position on the basis of the lateral frame 21A on the left, while the manual-feeder tray 100 is placed in the correct position with respect to the lateral frame 21A on the left.

More specifically, the lateral frame 21A on the left is formed to have a first boss 26 on an upper plane thereof, and the lateral frame 21A on the right is formed to have a second boss 27 on an upper plane thereof. Meanwhile, the frame 73 of the fixing unit 7 is formed to have an opening 73A at a left-side end thereof and a cutout 73B on a right-side end thereof. The opening 73A is formed to have a substantially equivalent size to fit with a size of the first boss 26. The cutout 73B is elongated leftward toward the opening 73A. An amount of a gap between a front edge and a rear edge of the cutout 73A is substantially equal to fit with a diameter of the second boss 27.

The opening 73A fits with the first boss 26 on the lateral frame 21A on the left, and the cutout 73B is engaged with the second boss 27 on the right. In other words, the frame 73 of the fixing unit 7 is placed in an eccentric position to be closer to the lateral frame 21A on the left with respect to a widthwise midst position between the lateral frame 21A on the right and the lateral frame 21A on the left. Further, the frame 73 of the fixing unit 7 is restricted from being rotated about the first boss 26.

Thus, while the manual-feeder tray 100 is placed in the fixed position with respect to the lateral frame 21A on the left, the frame 73 of the fixing unit 73 is placed in the fixed position with respect to the same lateral frame 21A on the left. Therefore, a relative position between the manual-feeder tray 100 and the fixing unit 7 is fixed correctly to each other via the lateral frame 21A on the left. Further, while the lateral frame 21A on the left supports the scanning unit 5 and the processing cartridge 6, a relative position among the manual-feeder tray 100, the scanning unit 5, and the processing cartridge 6 is fixed correctly with one another.

Figure 11:
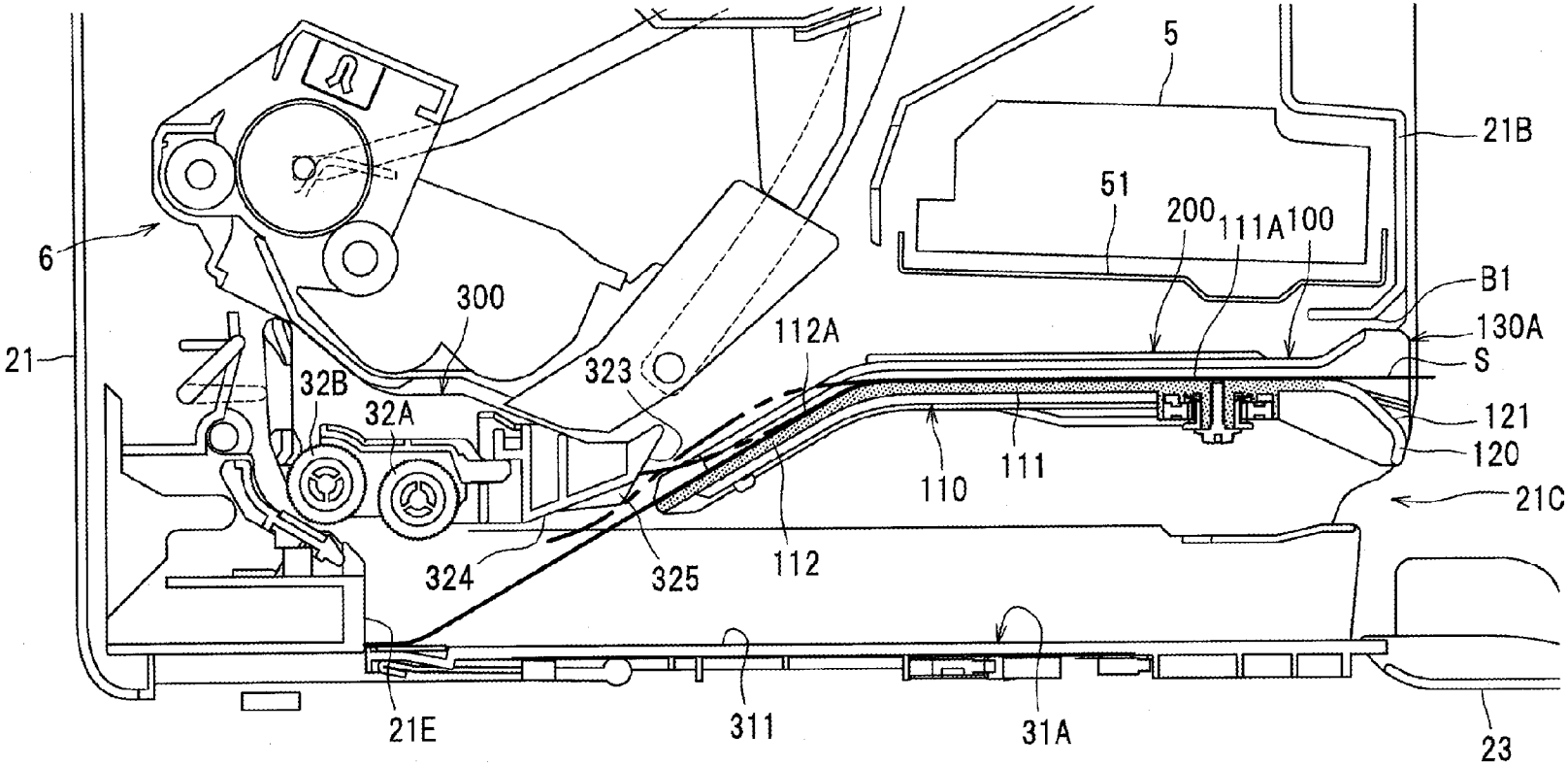
FIG. 11 is a cross-sectional view of the manual-feeder tray with sheets inserted in the laser printer according to the embodiment of the present invention.

Usability and effects of the configuration of the laser printer 1 described above will be described below. As shown in FIG. 11, when the sheet S is inserted in the manual-feeder tray 100, the front cover 23 is opened frontward to lie flat, and the sheet S is inserted through the upper part of the inlet 21C. In this regard, while the outer surface 121 of the handgrip 120 and the guides 130A protrude outside the chassis 21 to guide the sheet S inside through the inlet 21C, the sheet S can be inserted to be placed on the manual-feeder tray 100 smoothly compared to a manual-feeder tray, which is entirely arranged inside the chassis 21.

As the sheet S is inserted further on the manual-feeder tray 100, as indicated by the solid line in FIG. 11, the leading end of the inserted sheet S is placed on the sheet placement board 31A. In this regard, while the sheet placement board 31A is in the position on the extension of the second guiding surface 112A of the second guiding part 112, the leading end of the sheet S contacts the sheet placement board 31A before the sheet S contacts the restrictive wall 21E. Therefore, the sheet S can be prevented from being bent, which may otherwise be caused by contacting the restrictive wall 21E. Accordingly, the sheet S is restricted from slipping underneath the sheet placement board 31A.

When the leading end of the inserted sheet S is deformed to curl upward to be away from the second guiding part 112, as indicated by a dash-and-dot line in FIG. 11, the curled leading end contacting the first guiding plane 323 of the holder frame 300 can be guided to be closer to the sheet placement board 31A effectively.

On the other hand, when the inserted sheet S floats upward from the second guiding part 112, as indicated by a dash-and-double-dotted line in FIG. 11, the leading end of the sheet S may be curled downward to stream down from the second guiding part 112. In such a case, the sheet S contacting the projection 325 of the holder frame 300 can be lead toward the pickup roller 32A effectively.

According to the embodiment described above, the first guiding plane 323 and the projection 325 are formed integrally with the holder frame 300. Therefore, a quantity of parts to be used in the laser printer 1 may be reduced compared to a laser printer, in which the first guiding plane 323 and the projection 325 are formed separately from the holder frame 300.

When the instruction for printing is given to the laser printer 1, the leading end of the sheet S placed on the manual-feeder tray 100 is uplifted by the lifting member 31B via the sheet placement board 31A and contacts the pickup roller 32A. Thus, as the pickup roller 32 rotates, the sheet S is picked up and fed to the image forming unit 4.

According to the embodiment described above, the sheet placement board 31A and the lifting member 31B are used to uplift the sheet S on the manual-feeder tray 100 and on the feeder tray 31 toward the pickup roller 32A commonly. With the commonly usable sheet placement board 31A, a quantity of parts to be used in the laser printer 1 may be reduced compared to a laser printer, in which a mechanism to uplift the sheet S on the manual-feeder tray 100 is provided separately from the sheet placement board 31A and the lifting member 31B to uplift the sheet S on the feeder tray 31.

According to the embodiment described above, when the sheet S is jammed inside the chassis 21, it may be necessary that the user inserts a hand through the inlet 21C to remove the jammed sheet S. In the present embodiment, in this regard, the first guiding part 111, which is closer to the front cover 23 than the second guiding part 112 within the manual-feeder tray 100, spreads along the upper plane 311 of the sheet placement board 31A; in other words, an amount of the gap between the first guiding part 111 and the sheet placement board 31A is substantially constant along the front-rear direction. Therefore, a larger space inside the inlet 21C of the chassis 21 can be reserved compared to a configuration of a laser printer, for example, in which an entire manual-feeder tray is inclined linearly toward the pickup roller 32A, and an amount of the gap between the manual-feeder tray and the sheet placement board 31A is reduced constantly to be smaller toward the rear side along the front-rear direction. Thus, with the larger space inside the inlet 21C of the chassis 21, the user's hand may be easily inserted through the inlet 21C, and the maintenance works can be easily provided.

According to the embodiment described above, the first guiding part 111 of the manual-feeder inlet 100 is disposed in the upper position with respect to the pickup roller 32A. Therefore, the gap between the first guiding part 111 and the sheet placement board 31A is even more enlarged, and the larger space inside the inlet 21C of the chassis 21 can be reserved compared to a laser printer, in which the first guiding part 111 of the manual-feeder tray 100 is arranged in a lower or vertically equivalent position with respect to the pickup roller 32A.

According to the embodiment described above, as shown in FIG. 6, while the first extension plane S1 extended from the first guiding plane 111A of the first guiding part 111 intersects with the second extension plane S2 extended from the second guiding surface 112A of the second guiding part 112 at the intersection C1, the intersection C1 is arranged in a position closer to the rear side i.e., the opposite side from the front cover 23 across the center C, with respect to the center C along the front-rear direction. In this regard, the center C is an intermediate position between the end of the chassis 21 on the side where the inlet 21C is provided, i.e., the front end of the chassis 21, and the rear end of the sheet placement board 31A. In other words, the first guiding plane S1 is extended to be closer to the rear side of the chassis 21 beyond the center C. Thus, the deeper space inside the inlet 21C can be reserved in the chassis 21.

According to the embodiment described above, as shown in FIG. 2, the manual-feeder tray 100 can be removed from the chassis 21 by pulling the handgrip 120 frontward. When the manual-feeder tray 100 is removed from the chassis 21, the space having been occupied by the manual-feeder tray 100 is freed open; therefore, the space inside the inlet 21C is even more enlarged, and the user may provide the maintenance works easily. Further, with the handgrip 120, the user may remove the manual-feeder tray 100 easily from the chassis 21.

The removed manual-feeder tray 100 may be attached back to the chassis 21 by inserting the guided parts 140 in the rails 200 on the chassis 21 and sliding the guided parts 140 rearward along the rails 200. In this regard, the front parts of the rails 200 are formed on the front walls 21B, in which the inlet 21C is formed. Thus, the user may visually recognize the position of the rails 200 and insert the guided parts 140 in the rails 200 easily.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the sheet placement board 31A to uplift the sheet S from the feeder tray 31 toward the pickup roller 32A may not necessarily be provided. Instead, for example, the pickup roller 32A may be movable to be closer to contact the sheet S placed on the feeder tray 31.

For another example, a quantity of the projection 325 on the holder frame 300 may not necessarily be limited to one, but a plurality of projections 325 may be formed in the widthwise central area on the holder frame 300.

For another example, the first positioning part 144 and the second positioning part 145 may not necessarily be arranged in the displaced positions from each other along the front-rear direction. If the laser printer 1 is provided with a known registration roller, when the sheet S placed on the manual-feeder tray 1 is skewed to some extent with respect to a feeding direction of the sheet S, the registration roller may correct the skew of the sheet S; therefore, solely one of the positioning parts may be provided. For another example, the first positioning part 144 and the second positioning part 145 may align in line along the front-rear direction.

For another example, in the embodiment described above, the laser printer 1 having the image forming unit 4 with the scanning unit 5, the processing cartridge 6, and the fixing unit 7 is described as an example of the image forming apparatus according to the present invention. However, the image forming apparatus may not necessarily be a laser printer but may be an inkjet printer having an image forming unit, which includes an inkjet head to discharge ink onto a sheet being conveyed and a rail to support the inkjet head to be movable along a widthwise direction of the sheet. In this regard, the rail may be supported by a frame of the chassis and may be placed in a position with respect to the frame.

For another example, the handgrip 120 and the paired lateral guides 130 may not necessarily be formed separately but may be formed integrally. In this regard, however, the lateral guides 130 may not be movable along the widthwise direction but may be fixed to predetermined positions.

What is claimed is:

1. An image forming apparatus, comprising:

a chassis with an opening formed on one side thereof;

a first placement section, on which a sheet inserted through the opening is placeable;

a cover configured to be openable to expose the opening and closable to cover the opening and configured to form, when in a position to expose the opening, an outer part of the first placement section outside the chassis;

a second placement section arranged in an upper position with respect to the first placement section, and on which a sheet inserted through the opening is placeable; and a pickup roller configured to be disposed in the chassis on a side opposite from the cover across the opening and in an upper position with respect to the first placement section, wherein the second placement section is detachably attached to the chassis through the opening, wherein the second placement section comprises a first guiding part, the first guiding part extending in between the cover and the pickup roller along a sheet placement surface of the first placement section and comprising an end closer to the pickup roller and an end closer to the cover, and a second guiding part, the second guiding part extending from the end of the first guiding part closer to the pickup roller toward the pickup roller with inclination to be closer to the sheet placement surface of the first placement section, wherein the chassis comprises a guiding plane in a position between the pickup roller and the second guiding part of the second placement section, the guiding plane facing the second guiding part of the second placement section and extending with inclination toward the pickup roller to be closer to the sheet placement surface of the first placement section, and wherein an angle between the guiding plane of the chassis and the sheet placement surface of the first placement section is greater than an angle between a sheet placement surface of the second guiding part and the sheet placement surface of the first placement section.

2. The image forming apparatus according to claim 1, wherein the sheet placement surface of the second placement section at the first guiding part is arranged in an upper position with respect to the pickup roller.

3. The image forming apparatus according to claim 1, wherein an end of the second guiding part extending toward the pickup roller is arranged in a closer position from the cover with respect to the pickup roller.

4. The image forming apparatus according to claim 3, wherein the first placement section comprises a lifting member configured to uplift the sheet placed on the first placement section toward the pickup roller, wherein the image forming apparatus comprises a restrictive wall arranged on an opposite side with respect to the lifting member from the cover across the opening, wherein the lifting member is arranged on an extension line along a sheet placement surface of the second guiding part.

5. The image forming apparatus according to claim 1, wherein an intersection, in which a first extension plane extended along the sheet placement surface of the first guiding part intersects with a second extension plane extended along a sheet placement surface of the second guiding part, is arranged in an eccentric position closer to an end of the first placement section opposite from the cover across the opening with respect to a center between one end of the chassis closer to the cover on the side having the opening and another end of the chassis on a side opposite from the cover across the opening.

6. The image forming apparatus according to claim 1, wherein the chassis comprises a holder frame configured to support the pickup roller, and wherein the guiding plane is formed on the holder frame.

7. The image forming apparatus according to claim 6, wherein the holder frame comprises a projection formed to protrude toward a widthwise central position for the sheet on the second placement section.

8. An image forming apparatus, comprising:

a chassis with an opening formed on one side thereof;

a first placement section, on which a sheet inserted through the opening is placeable;

a cover configured to be openable to expose the opening and closable to cover the opening and configured to form, when in a position to expose the opening, an outer part of the first placement section outside the chassis;

a second placement section arranged in an upper position with respect to the first placement section, and on which a sheet inserted through the opening is placeable;

an image forming unit configured to form an image on the sheet, wherein the chassis comprises a pair of frames arranged to be spaced apart from each other, each of the paired frames being formed in a single piece, a wall, an edge of which forms an edge of the opening, and a guide, which is configured to guide the second placement section being attached to the chassis, wherein the guide is formed over the wall and each of the paired frames continuously wherein one of the paired frames supports the image forming unit at least partly, wherein the second placement section is detachably attached to the chassis through the opening, and comprises a positioning part, which is engageable with the one of the paired frames, wherein the second placement section is placed in a correct position with respect to the one of the paired frames by the positioning part being engaged with the one of the paired frames.

9. The image forming apparatus according to claim 8, wherein the image forming unit is at least partly placed in a correct position with respect to the one of the paired frames.

10. The image forming apparatus according to claim 8, wherein the image forming unit comprises a photosensitive drum, a scanning unit configured to scan the photosensitive drum, and a fixing unit, and wherein at least one of the photosensitive drum, the scanning unit, and the fixing unit is placed in a correct position with respect to the one of the paired frames.

11. The image forming apparatus according to claim 8, wherein the positioning part of the second placement section comprises a first positioning part and a second positioning part, the second positioning part being arranged in a position displaced from the first positioning part along a direction of attaching the second placement section to the chassis.

12. An image forming apparatus, comprising:

a chassis with an opening formed on one side thereof;

a first placement section, on which a sheet inserted through the opening is placeable;

a cover configured to be openable to expose the opening and closable to cover the opening and configured to form, when in a position to expose the opening, an outer part of the first placement section outside the chassis; and a second placement section arranged in an upper position with respect to the first placement section, and on which a sheet inserted through the opening is placeable, wherein the second placement section is detachably attached to the chassis through the opening, and wherein the second placement section comprises a main part, on which the inserted sheet is placeable, the main part comprising an end closer to the cover and an end farther from the cover, and a handgrip formed to protrude from the end of the main part closer to the cover toward the cover.

13. The image forming apparatus according to claim 12, wherein the end of the main part closer to the cover is arranged in a position opposite from the cover across the opening.

14. The image forming apparatus according to claim 13, wherein the handgrip is arranged to protrude toward the cover beyond the opening.

15. The image forming apparatus according to claim 14, wherein the cover comprises a plurality of ribs protruding inwardly from an inner surface thereof, the inner surface being on an inner side of the cover when the cover is in a closable position to cover the opening, and wherein the plurality of ribs are formed in different positions from the handgrip, when the cover is in the closable position to cover the opening, along an aligning direction, in which the cover and the opening align with each other.

16. The image forming apparatus according to claim 12, wherein, while the handgrip comprises an end closer to the main part and an end farther from the main part, the end of the handgrip farther from the main part is arranged in a lower position with respect to a sheet placement surface of the main part, and an outer plane of the handgrip extends with inclination from the lower position with respect to the sheet placement surface of the main part to be closer to the sheet placement surface of the main part.

17. The image forming apparatus according to claim 12, wherein the second placement section comprises a lateral guide, which is configured to restrict a widthwise position of the sheet on the second placement section by contacting widthwise ends of the sheet placed on the main part of the second placement section, wherein the lateral guide comprises a restrictive part configured to restrict a position of the sheet on the main part of the second placement section along a direction of thickness, and wherein the restrictive part comprises a protrusive portion configured to protrude toward the cover with respect to the end of the main part closer to the cover.

18. The image forming apparatus according to claim 17, wherein the restrictive part comprises a lower-side restrictive surface, which is configured to contact a lower surface of the sheet, and wherein, while the protrusive portion in the restrictive part comprises an end closer to the main part and an end farther from the main part, the lower-side restrictive surface of the end of the protrusive portion farther from the main part is arranged in a lower position with respect to a sheet placement surface of the main part, and the lower-side restrictive surface of the protrusive portion extends with inclination from the lower position with respect to the sheet placement surface of the main part toward an inner side of the chassis to be closer to the sheet placement surface of the main part.

19. The image forming apparatus according to claim 18, wherein the lower-side restrictive surface of the restrictive part protrudes toward the cover beyond the opening.

20. The image forming apparatus according to claim 17, wherein the restrictive part comprises an upper-side restrictive surface, which is configured to contact an upper surface of the sheet, and wherein, while the protrusive portion in the restrictive part comprises an end closer to the main part and an end farther from the main part, the upper-side restrictive surface of the end of the protrusive portion farther from the main part is arranged in an upper position with respect to a sheet placement surface of the main part, and the upper-side restrictive surface of the protrusive portion extends with inclination from the upper position with respect to the sheet placement surface of the main part toward an inner side of the chassis to be closer to the sheet placement surface of the main part.

21. The image forming apparatus according to claim 20, wherein the upper-side restrictive surface of the restrictive part protrudes toward the cover beyond the opening.

* * * * *